United States Patent [19]

Kleber et al.

[11] 4,261,839

[45] Apr. 14, 1981

[54] TERTIARY BUTYL ETHERS AS FIBER PREPARATION AGENTS

[75] Inventors: Rolf Kleber, Neu-Isenburg; Siegfried Billenstein, Burgkirchen, both of Fed. Rep. of Germany

[73] Assignee: Hoechst Aktiengesellschaft, Fed. Rep. of Germany

[21] Appl. No.: 21,979

[22] Filed: Mar. 19, 1979

[30] Foreign Application Priority Data

Mar. 22, 1978 [DE] Fed. Rep. of Germany ..... 2812444

[51] Int. Cl.[3] ..... D06M 13/18

[52] U.S. Cl. ..... 252/8.9; 568/671; 568/687; 568/689; 568/697

[58] Field of Search ..... 568/687, 671, 672, 694, 568/697, 689, 601; 252/8.6, 8.9

[56] References Cited

U.S. PATENT DOCUMENTS

| | | | |
|---|---|---|---|
| 1,968,601 | 7/1934 | Edlund et al. | 568/697 |
| 2,126,314 | 8/1938 | Dickey et al. | 252/8.9 |
| 2,139,359 | 12/1938 | Evans et al. | 568/671 |
| 2,184,009 | 12/1939 | Dicke y et al. | 252/8.9 |
| 2,191,039 | 2/1940 | Dickey et al. | 252/8.9 |
| 2,196,744 | 4/1940 | Dickey et al. | 252/8.9 |
| 2,480,940 | 9/1949 | Leum et al. | 568/697 |
| 3,888,775 | 6/1975 | Koizumi et al. | 252/8.9 |
| 3,983,043 | 9/1976 | Brandeis et al. | 252/8.9 |
| 4,111,819 | 9/1978 | Muijs | 252/8.9 |

*Primary Examiner*—Joseph L. Schofer
*Assistant Examiner*—Herbert J. Lilling
*Attorney, Agent, or Firm*—Connolly and Hutz

[57] ABSTRACT

A fiber preparation containing or consisting of a tertiary butyl ether of the general formula

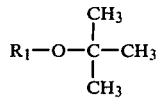

in which $R_1$ is a straight-chain or branched $C_{12}$–$C_{22}$–alkyl or alkenyl group.

1 Claim, No Drawings

TERTIARY BUTYL ETHERS AS FIBER PREPARATION AGENTS

The present invention relates to tertiary butyl ethers as fiber preparation agents.

The use of mineral oils with different viscosities in the texturizing of fibers is well-known. Besides the mineral oils, there are also employed paraffin products, animal fats and vegetable oils (Fette, Seifen, Anstrichmittel 1955, pages 564 et seq.). By adding emulsifying agents, these products which are in most cases water-soluble are converted into fiber preparations which may be emulsified in water.

However, the current development of fiber-preparation calls for new alternatives to the mineral oils in the very field of lubricants, for mineral oils as lubricating components might resinify in texturizing processes. Due to the close relation between friction and viscosity, the search for alternatives is becoming more and more important in cases where a lower friction is desired, for example in spinfinish preparations for double twisting and in coning oils. Besides, the question of a possible degradation by mineral oils also plays a significant part for polyolefin fibers (polypropylene, polyethylene fibers) which gain more and more importance (cf. "International Dyer and Textile Printer", pages 525 and 532 (1975)).

It has now been found that as lubricants in fiber preparations with a low friction coefficient there may be used the tertiary butyl ethers of aliphatic alcohols of the following formula:

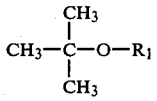

in which $R_1$ is a straight-chain or branched $C_{12}$–$C_{22}$-alkyl or alkenyl group.

In this case it is surprising that the bulky t-butyl group leads to such a low friction coefficient, as it is well-known that the branching itself in aliphatic radicals increases the friction in fiber preparation agents. The preparation of the t-butyl ethers is effected preferably as has been described in German Patent No. 15 20 647 by reacting corresponding alcohols with isobutylene in the presence of a sulfonated copolymer of styrene and divinylbenzene in the hydrated acid form.

The water-insoluble colorless t-butyl ethers may be used as pure components by themselves, i.e. free from water for the texturizing of fibers, however, said compounds are predominantly emulsified with the commong emulsifying agents, for example oxethylated nonyl phenols, in water and are applied in the form of aqueous emulsions of this kind onto the fibers, for example by slop-padding, spraying or dipping. These aqueous emulsions contain generally from 10 to 30% by weight of the t-butyl ether. The amount of active substance applied on the fiber in the preparation process is from about 0.3 to 2, preferably from 0.4 to 0.8% by weight. Besides the t-butyl ether, said fiber preparation agents may also contain other common additives, for example phosphorus pentoxide esters in their neutralized form as antistatic agents and agents effecting a compactness of the thread. The t-butyl ethers described are suitable for the preparation of natural as well as of synthetic fibers, for example cotton, polyester, polyamide or polyacrylonitrile.

The t-butyl ethers described do not turn yellow after heating processes. They represent low-viscosity colorless liquids which do not swell up the polyurethane material of texturizing reels, for example. In contrast to mineral oils they do not swell up polyolefin fibers either and thus do not cause a damaging of these fibers.

Preparation of the $C_{16/20}$-alkyl-tert. butyl ether (product a)

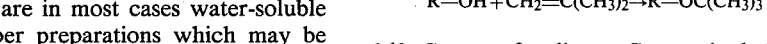

$$R{-}OH + CH_2{=}C(CH_3)_2 \rightarrow R{-}OC(CH_3)_3$$

260 Grams of a linear $C_{16/20}$ alcohol (=1 mol) are placed into a pressure vessel having a capacity of 1 liter and being provided with a stirrer, a receiver and the usual fittings and are freed from water possibly contained therein by 3 hours of drying while stirring at 90° C. and under reduced pressure (residual pressure of 15 to 20 mbars). After cooling to about 50° C., 20 g of Amberlyst 15 are added as catalyst (Amberlyst 15 is a pre-dried acid ion exchanger resin produced by Messrs. Roehm & Haas).

The gas chamber above the reaction mixture is rinsed several times with nitrogen. Thereafter 112 g of isobutylene (=2 mols) are introduced within a period of from 30 minutes to 1 hour from the receiver into the fatty alcohol/catalyst mixture.

Upon completing the addition, the mixture is continued to be stirred for 6 to 8 hours at a temperature of from about 30° to 40° C.

The excess pressure in the reaction vessel is maintained so that the isobutylene remains in the liquid phase as far as possible. After this reaction period the pressure in the autoclave is slowly released to reach atmospheric pressure. Upon opening the pressure vessel, the crude ether is decanted from the precipitated solid matter catalyst and is mixed with traces of a fatty amino oxethylate in order to neutralize the small proportions of acid catalyst dissolved.

The hydroxyl number is 3.

The missing residual ether yield remains in the solid matter catalyst having precipitated. However, as the catalyst may be used several times, this is not a real loss.

The crude ether is then freed from the volatile proportions at a temperature of 80° C. at a maximum and a residual pressure of from 15 to 20 mbars. There are obtained 300 g of the liquid colorless $C_{16/20}$-alkyl-t-butyl ether.

In a similar manner there are prepared the t-butyl ethers of (b) isotridecyl alcohol
(c) $C_{12/14}$-alcohol (saturated)
(d) linear $C_{12/15}$-alcohol (saturated)
(e) linear $C_{16/19}$-alcohol (saturated)
(f) oleyl alcohol.
(g) As comparison product there was considered a mineral oil of the following composition: 0% of aromatic compounds; 32% of paraffins; 68% of naphthenes.

Products (a) to (g) were subjected to the following tests:

(a) Measurement of the viscosity (in cP) at 20° C.
(b) Determination of the sliding friction of the products applied in the anhydrous state on PA filaments (dtex. 220 f 40), amount applied: 0.8% of active substance; filament/metal friction according to the measuring arrangement described in German Offenlegungsschrift No. 2416430 at 25 m and a draw-off rate of 100 m/min.

(c) Yellowing test: 220° C./1 hour

Measurement of the yellowing (iodine color number according to DIN No. 6,162) The measurement showed the following values:

| | | a | b | c |
|---|---|---|---|---|
| a. | | 9 | 0.180–0.230 | 2 |
| b. | | 8 | 0.250–0.295 | 2 |
| c. | | 8 | 0.245–0.295 | 2 |
| d. | | 9 | 0.230–0.285 | 2 |
| e. | | 11 | 0.220–0.280 | 2 |
| f. | | 13 | 0.230–0.290 | 8 |
| g. | (Comparison) | 5 | 0.280–0.340 | 300 |

The comparison sample (low-viscosity mineral oil) shows a higher friction in spite of a lower viscosity, together with a stronger yellowing after the heating test.

Furthermore, there were compared an ester oil (pentaerythritol-tetradecylate) as water-insoluble lubricant according to German Auslegeschrift No. 23 04 221 and the t-butyl ether of $C_{16/20}$-alkanol (a) as described above.

A stock mixture was prepared which had the following composition:

4 parts by weight of lubricant 6 parts by weight of emulsifier consisting of 2 parts of oleyl alcohol.5EO 1 part of $POCl_3$ ester of $C_{12}H_{25}OH$.4EO (neutralized with NaOH)

1.5 parts of castor oil.36EO 1.5 parts of coconut oil acid.10EO

The micro-emulsions (15% of active substance) prepared with water at 40° C. were applied onto PES filaments (dtex 167 f 32) and were tested for their sliding friction in a manner analogous to that described above. The following values were measured in this process:

| | Sliding friction (of the emulsions) |
|---|---|
| (1) t-butyl ether (product a) | 0.190–0.235 |
| (2) PE-tetradecylate (comparison) | 0.215–0.270 |

| | Viscosity of the pure products |
|---|---|
| (1) t-butyl ether (product a) | 9 cP at 20° C. |
| (2) ester oil | 70 cP at 20° C. |

| | Volatility and yellowing at 220° C. | |
|---|---|---|
| | 1 hour | 24 hours |
| (1) t-butyl ether (pure) | 19% (2) | 99% (300) |
| (2) ester oil | 1% (2) | 45% (1.100) |
| (1) t-butyl ether (plus emulsifier) | 2% (7) | 70% (900) |
| (2) ester oil (plus emulsifier) | 2% (7) | 54% (1.100) |

The comparison tests show that the t-butyl ether of the $C_{16/20}$-alkanol has lower friction values and a lower viscosity than the pentaerythritol ester. In spite of a higher volatility according to a test carried out at 220° C., the high volatility shows that the t-butyl ether hardly forms any deposits, for example, on the heating elements of texturizing machines, thus being clearly superior to the sterically hindered pentaerythritol ester.

What is claimed is:

1. A fiber preparation composition containing (1) a tertiary butyl ether of the formula

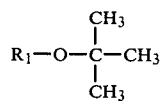

in which $R_1$ is a straight chain or branched $C_{12}$–$C_{22}$ alkyl or $C_{12}$–$C_{22}$ alkenyl and (2) an emulsifier.

* * * * *